United States Patent [19]

Hallberg et al.

[11] Patent Number: 4,742,741

[45] Date of Patent: May 10, 1988

[54] ROTARY SHEETER

[75] Inventors: Edwin A. Hallberg; Gary C. Welsh, both of Midland, Mich.

[73] Assignee: The Dow Chemical Company, Midland, Mich.

[21] Appl. No.: 848,543

[22] Filed: Apr. 7, 1986

[51] Int. Cl.[4] ..... B26D 1/62

[52] U.S. Cl. ..... 83/37; 83/298; 83/300; 83/305; 83/337; 83/345; 83/674

[58] Field of Search ..... 83/37, 305, 325, 327, 83/328, 337, 343, 345, 346, 347, 674, 298, 300

[56] References Cited

U.S. PATENT DOCUMENTS

| | | | |
|---|---|---|---|
| 1,802,554 | 4/1931 | Hahn | 83/345 |
| 1,975,350 | 10/1934 | Davis | 83/345 |
| 2,855,998 | 10/1958 | Einhiple | 83/327 |
| 3,251,265 | 5/1966 | Cvacho et al. | 83/328 |
| 4,083,273 | 4/1978 | Hillman et al. | 83/327 |
| 4,218,944 | 8/1980 | Sclippa | 83/345 |

*Primary Examiner*—E. R. Kazenske
*Assistant Examiner*—Hien H. Phan

[57] ABSTRACT

A versatile, space-efficient rotary sheeter including a pair of roll assemblies synchronously driven and rotating at web speed. Each assembly carries cooperating revolving cutter rolls and backup slot rolls staggered on opposed supporting roll assemblies and being readily shiftable, through gearing, between time-controlled operative and inoperative phasing modes for conveniently converting a moving web of roll stock of sheet material into cut segments of selectable lengths. The apparatus is physically fixed in place during operation and operates without any need for an accumulation loop in the moving web. The sheeter is readily adjustable, easily maintained, and has enhanced safety features. It operates over a wide range of adjustable speeds to accommodate web stock of various compositions and thickness.

23 Claims, 4 Drawing Sheets

T
P
V
V
320
328
324
350
176
300
310
340
330
304
110
114
308
338
140
334
146
144
80
40
50
70
86
92
100
76
48
84
92
176

304
30
3
32
334
40
204
220
224
48
62
88
92
100
20
24
28
84
70
54
74
76
140
114
110
30
32
44
160
88
92
100
3

ROTARY SHEETER

BACKGROUND AND FIELD OF THE INVENTION

The present invention relates to an apparatus for transforming a moving web into segments by severing the web transversely of its direction of advance. More particularly, the invention is directed to a rotary sheeter which is conveniently adjustable to provide cut web segments of selectable length and operating at high speed and efficiency with no need to provide an accumulation loop.

It is a feature of the invention that the apparatus is fixed during its operation and that the cutting elements themselves do not travel lineally during operation of the machine.

Yet another important feature of the invention is that the apparatus is readily and easily adjustable over a wide range to provide segments of various selectable lengths and is suitable for use with a variety of products including plastics and paper webs.

A related feature of the invention is that the sheeter apparatus operates effectively and safely at high speeds, and requires a minimum of attention and maintenance.

A general characteristic of the invention is that it is relatively simple in construction and efficient in operation and functions effectively upon webs of various thicknesses.

SUMMARY OF THE INVENTION

In a preferred embodiment the rotary sheeter of the invention is space efficient and operates through cooperating revolving cutter rolls and backup slot rolls staggered on opposed supporting roll assemblies and being readily shiftable through gearing between time-controlled operative and inoperative phasing modes for conveniently converting a moving web of roll stock sheet material into cut segments of selectable lengths. In a preferred embodiment, the apparatus is physically fixed in place during operation and functions without any need for an accumulation loop in the moving web.

Other important features of the sheeter of the invention are that it is readily adjustable, easily maintained, and has enhanced safety features.

A practical feature of the invention is that it operates over a wide range of adjustable speeds to accommodate web stock of various compositions and thicknesses.

The sheeter of the invention includes a pair of roll assemblies synchronously driven and rotating at web speed, each assembly carrying cooperating revolving and pivoting cutter rolls and backup slot rolls staggered on opposed supporting roll assemblies and being readily shiftable between a standby and an operating mode.

A related feature of the invention is that it includes a pair of spaced, coextensive and parallel roll assemblies each of which supports an array of cutter rolls and slot rolls in alternating disposition and distributed about a perimetric margin of the roll assembly. The cutter rolls and slot rolls are staggered on one of the roll assemblies with respect to mating slot rolls and cutter rolls on the opposed roll assembly, the cutter rolls and the slot rolls revolving about respective fixed axes of corresponding roll assemblies on axes which are eccentric with respect to axes of the roll assemblies.

It is a feature of the sheeter of the invention that the cutter rolls and slot rolls are disposed for planetary revolution in a feris-wheel fashion about a fixed center axis of respective roll assemblies and are mechanically coupled to the center axis so as to establish and maintain a fixed annular orientation of the cutter rolls and slot rolls with respect to their own axes.

A related feature of the invention is that during revolution of the opposed roll assemblies, the cutter rolls of one assembly shift or actuate to allow the knife blades of the activated cutter rolls of one assembly to be received in the slots of cooperating slot rolls, and the slot rolls of the other assembly thereby to effect transverse severence of the web moving between the revolving roll assemblies during the cutting operation.

It is a feature of the sheeter apparatus of the invention that the knife-blade of the cutter rolls is programmed in its rotational cycle to extend at right angles to a plane of the moving web at the time the edge of the knife-blade is presented to sever the web.

A related feature of the invention is that the orientation and relationship of the cutter rolls and the slot rolls on the roll assemblies is such as constantly to maintain the cutter blades of the cutter rolls normal to the path of the web moving between the roll assemblies, as the cutter blades enter into the slots of the opposed slot rolls during the cutting operation.

Yet another feature of the sheeter of the invention is that there are provided feed rolls for advancing the web at a speed which corresponds with the circumferential lineal rate of movement of the roll assemblies, thereby obviating any need for maintaining an accumulation loop in the moving web.

The cutter rolls and slot rolls carried by one of the roll assemblies constitute an opposite duplicate in their spacial disposition as compared with the cutter rolls and slot rolls on the opposed roll assembly so that a cutter blade of one of the roll assemblies mates alternately with a slot roll of the opposed roll assembly.

Yet another feature of the sheeter of the invention is that there are included feed rolls which advance the web toward the cutters, and rolls which remove the leading end of the web after severence, the surface speed of the rollers corresponding to the speed of the web-bridging roll assemblies.

In one preferred embodiment of the invention the web removing rolls are driven at a surface speed which is at least as great as and possibly somewhat in excess of that of the feed rolls.

An important feature of the cutter rolls and the slot rolls of the invention is that they are supported on the roll assemblies so as to bring the respective functional components of the cutter roll and the slot roll into mating engagement at time spaced intervals correlated with concurrent presentation of the knife-blade of the cutter roll to enter into the slot of the slot roll during severence of the moving web.

A related feature of the invention is that there are provided camming means by which the angular disposition of the cutter rolls and the slot rolls in each of the roll assemblies is shifted so as to preclude interfunctional engagement of the knife-blade of the cutter rolls into the slot of the slot rolls when respective said cutter and slot rolls directly oppose the web traveling between the roll assemblies.

It is an important practical feature of the invention that the rotary sheeter represents a marked improvement over prior art traveling-type sheers with their inherent complexity, safety hazards, and excessive mechanical wear and tear on moving components.

Yet another related feature of the invention is that there is provided a mechanism for controlling the camming action of the mechanism by which the cutter rolls and slot rolls are rendered inoperative, thus establishing a simple method for selectively adjusting the linear length of segments cut transversely from the moving web.

A specific preferred structural feature of the knife-blade of the cutter roll of the invention is that the blade edge is serrated.

In a preferred embodiment of the invention one of the elements defining a bounding wall of the slot formed in the slot roller is supported on a block which is in turn biased radially outwardly and is resiliently responsive to pressure applied thereagainst to move radially inwardly into the slot roll.

In accordance with the sheeter of the present invention it is feasible to provide sheets having a length which is 1/n of the circumferential length of the assemblies where n is the total number of knife rolls and slot rolls o each of the assemblies.

A related feature of the invention is that web segments having lengths intermediate those of integral multiples of arcuate sectors of the roll assemblies defined by the positioning of the cutter rolls and slot rolls are obtained by varying the relative lineal speed of the web driving apparatus and the circumferential lineal speed of the roll assemblies.

In a preferred embodiment of the invention the roll assemblies have a circumference of about two feet and each carries four rolls (two cutter rolls and two slot rolls), so that the smallest incremental sheet severed in normal operation is six inches in length.

It is a related feature of the invention that there are provided means in the form of cams or electronic timing devices which are selectively adjustable and act upon mechanical drives for shifting the annular positions of the cutter rolls and slot rolls carried by the roll assemblies between web severing operative modes and "stand-by" inoperative modes, thereby to control the lengths of segments served from the moving web.

Other and further objects, features and advantages of the invention will become evident from the following detailed description considered in conjunction with the accompanying drawings.

DETAILED DESCRIPTION OF PREFERRED EMBODIMENTS

Figure 2:
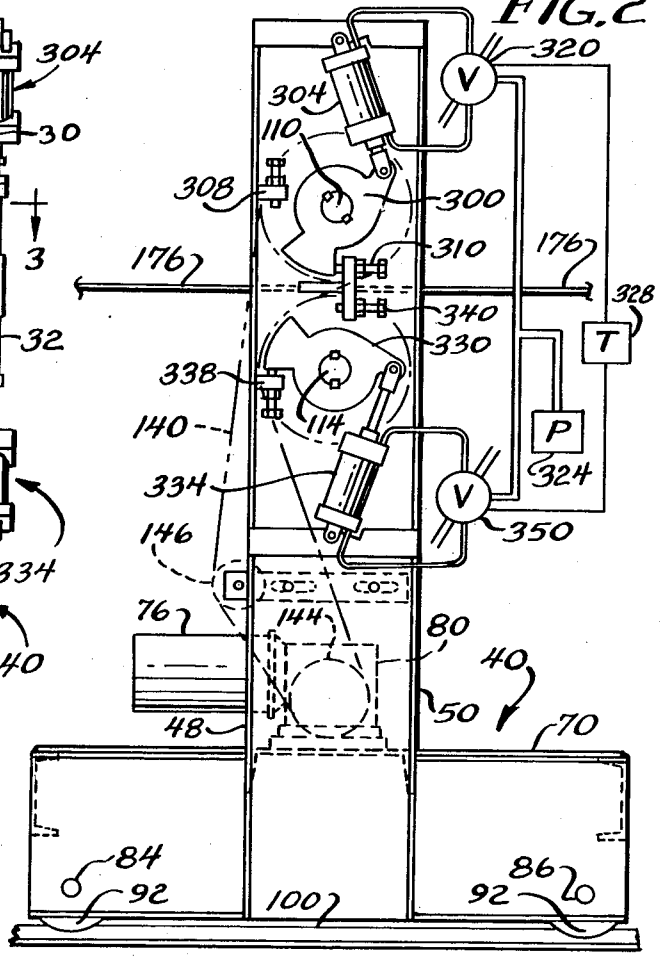
FIG. 2 is an elevational view showing, diagramatically, pneumatic mechanisms and control devices for selectively shifting center axes of the roll assemblies to establish, selectively, operative and inoperative modes of the cutter rolls and slot rolls of the sheeter of the invention.

The aims and objects of the present invention are achieved by providing, in a space-efficient rotary sheeter, apparatus for conveniently and effectively cutting a continuously moving weo of sheet material to provide severed sheet increments or segments of selectably adjustable lengths. The apparatus itself is physically fixed in position during operation and functions without any requirement for establishing an accumulation loop in the moving web.

In the exemplary embodiment of the invention described, the apparatus includes a pair of generally coextensive cooperating cylindrical rotatable roll assemblies carried on a frame and having fixed axes parallel to each other. The roll assemblies are spaced from each other to define a limited passageway for receiving a web of sheet material which is driven to move freely therethrough to accommodate webs of varying thicknesses up to about one quarter inch. The apparatus is further characterized in that there are provided driving means for rotating the roll assemblies in unison to provide a peripheral lineal speed which may be conveniently correlated with a speed of the advance of the web between the roll assemblies.

The roll assemblies each support a plurality of annularly spaced cutter rolls and slot rolls in an alternating array and staggered to that a cutter roll carried by one of the roll assemblies comes into functional registry with a slot roll of the opposed roll assemblies during synchronized rotation of the roll assemblies in opposed directions. The cutter rolls and slot rolls disposed around each respective roll assembly within an encircling bounding marginal zone of the assemblies include means for pivotally arcuately shifting the rolls between an operative functional mode and a standby mode in which no cutting of the advancing web occurs, thereby to provide means for effectively regulating the lineal length of segments to be severed from the moving web.

In the specific preferred embodiment of the invention depicted and described, the cutter rolls and slot rolls carried by the roll assemblies include means for orbitally revolving the cutter rolls and slot rolls about respective axes of the roll assemblies as the latter rotate. During each rotation of the roll assemblies, each cutter roll and each slot roll functions in a ferris-wheel fashion as if gravitationally supported on its axis. That is, each roll remains fixed with respect to its own axis. In the arrangement described, the cutter rolls and the slot rolls carried by a first of the pair of roll assemblies are in an out-of-phase sequence with respect to cooperating cutter rolls and slot rolls carried by the opposed second of the roll assemblies. Upon selectively actuating the mechanism for pivotally shifting the cutter rolls and slot rolls, a given cutter roll of one of the roll assemblies approaches proximate to and directly oppose a cooperating slot roll in the other of the roll assemblies during ganged synchronous rotation of the roll assemblies in opposite directions about their respective axes, and severance of the moving web is achieved.

Each cutter roll carries a knife-blade extending longitudinally therealong, the knife-blade being supported to project in a plane paralleling an elongated axis of the cutter roll and radially beyond a periphery of the cutter roll during controlled periodic presentation of an outwardly extending cutting edge of the knife-blade to engage a web travelling through the passageway between the roll assemblies to convert the web into cut sheets of selectable lengths. Cooperatively, each of the slot rolls is formed with a slot which extends longitudinally therealong and radially inwardly from a peripheral bounding circumference of the slot roll for periodically receiving a projecting free cutting edge of the knife-blade upon engagement of the blade with the web being severed. In a preferred embodiment of the invention the cutter rolls and slot rolls of each respective roll assembly are mechanically coupled for synchronous annular shift or displacement between operative and inoperative modes by means of sprockets and associated sprocket chains, the latter being trained over a center shaft sprocket of the roll assemblies and over sprockets affixed to the rolls to facilitate ganged annular shift or displacement of the rolls as the apparatus operates periodically to bring a given cutter roll carried by a first of the roll assemblies into cooperating functional transposition with a slot roll carried on the opposed roll assemblies as the roll assemblies rotate.

In the specific preferred embodiment of the invention described below, the sprocket chains function, through a camming assembly connected to the center shaft of each roll assembly to shift the cutter rolls and the slot rolls simultaneously through equal circumferential arcuate sectors for establishing an operative mode of the cooperating cutter rolls and slot rolls, and for regulating and controlling sequential presentation of the knife-blades into opposedly presented slots of corresponding mating slot rolls carried by the opposed roll assembly. In the arrangement described, controlled arcuate shifting of the rolls through an annular arc of about 45 degrees is effective selectively to establish and to prevent functional intercooperation of the cutter rolls and slot rolls and, thereby, selectively to effect and to prevent severence of the web as the latter travels between the roll assemblies.

In a specific preferred embodiment of the rotary sheeter of the invention described below and illustrated in the accompanying drawings, the circumference of each roll assembly is two feet and each assembly carries two cutter rolls and two slot rolls in an alternating array, that array being staggered on one of the roll assemblies with respect to the opposed roll assembly. In the arrangement described, and in a mode in which each of the cutter rolls and its cooperative slot roll operates functionally, and with the web moving at a lineal speed corresponding to the circumferential lineal speed of the roll assemblies, the web may be severed four times for a given rotation of the roll assemblies, and the length of the severed segment would then be six inches. As previously indicated, segments of longer lengths are produced by controlling the annular orientation of the cutter rolls and slot rolls so that functional mating occurs only at time-spaced intervals controlled through camming mechanisms which regulate the annular orientation of the cutter and slot rolls. Additionally, deviations from the lengths obtained through a simple mathematical relationship as described above may be achieved by varying somewhat the lineal speed of the web as compared with the circumferential lineal speed of the roll assemblies.

Figure 1:
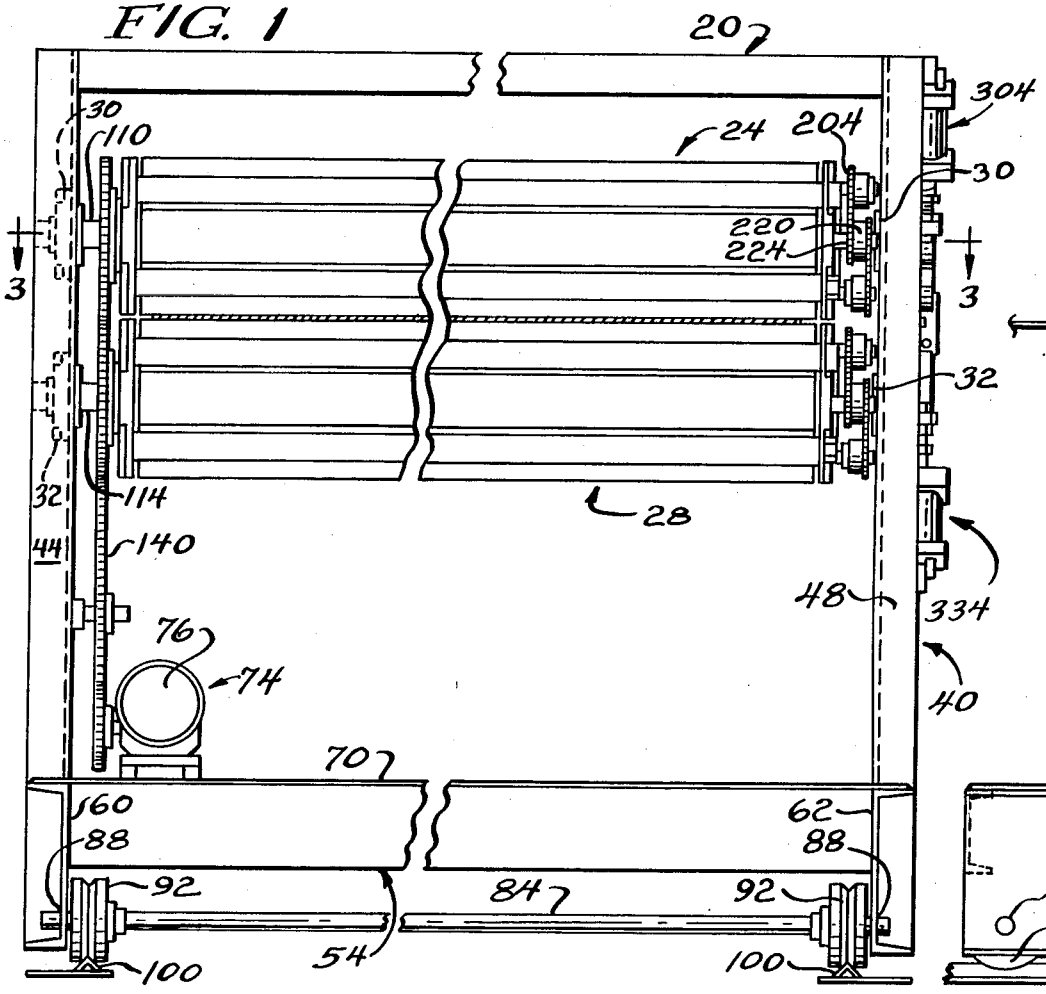
FIG. 1 is a side elevational view of a sheeter apparatus which embodies the present invention and showing the cooperating roll assemblies rotatably supported on a frame riding on rails, the roll assemblies being coupled to a motor-driven chain and being driven unison.
Figure 3:
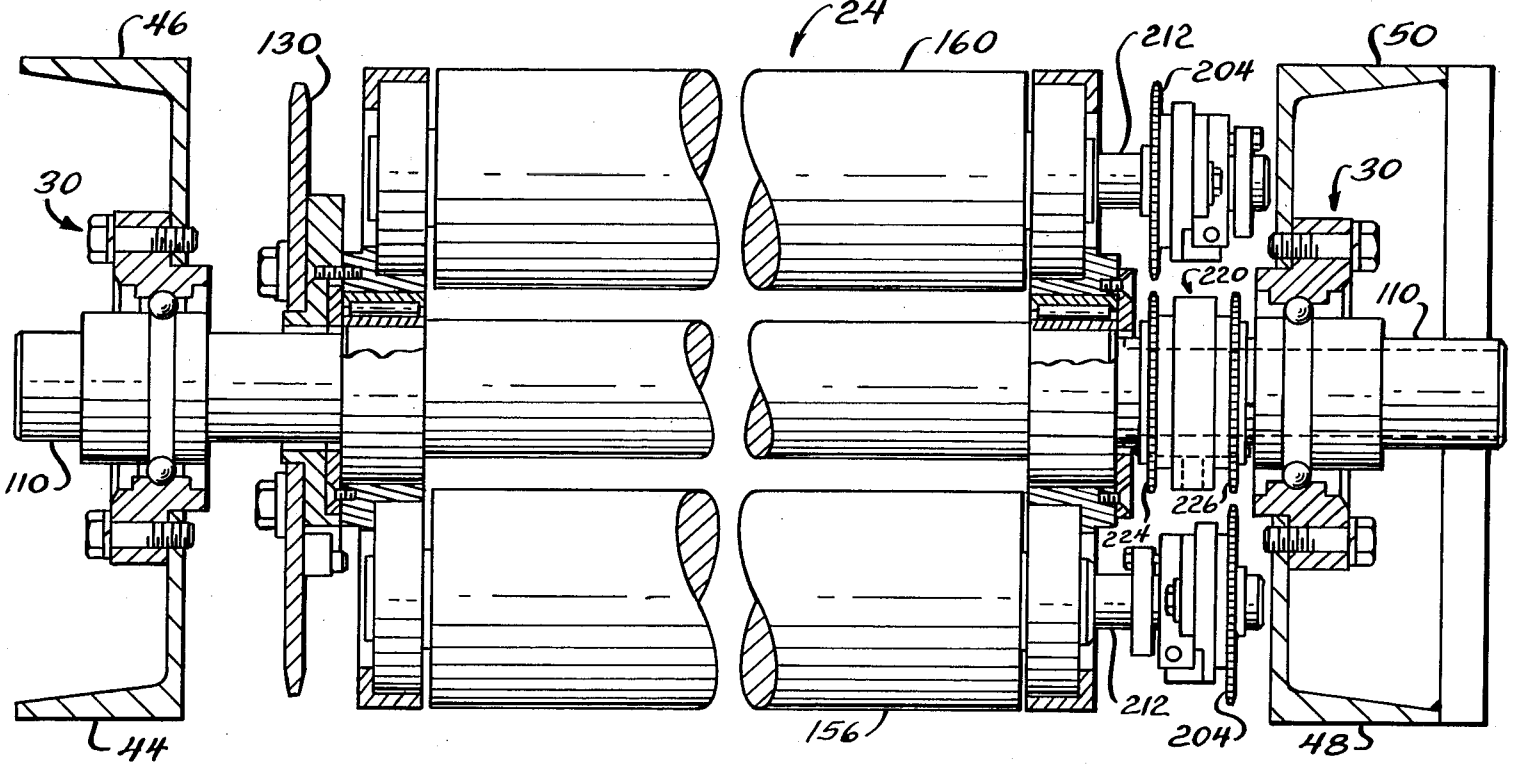
FIG. 3 is an enlarged, cross-sectional view taken substantially on the lines 3—3 of FIG. 1 and indicating schematically the support bearings and the drive sprockets and center axle and roll sprockets by means of which the cutter rolls and slot rolls are shifted between operative and inoperative modes.
Figure 4:
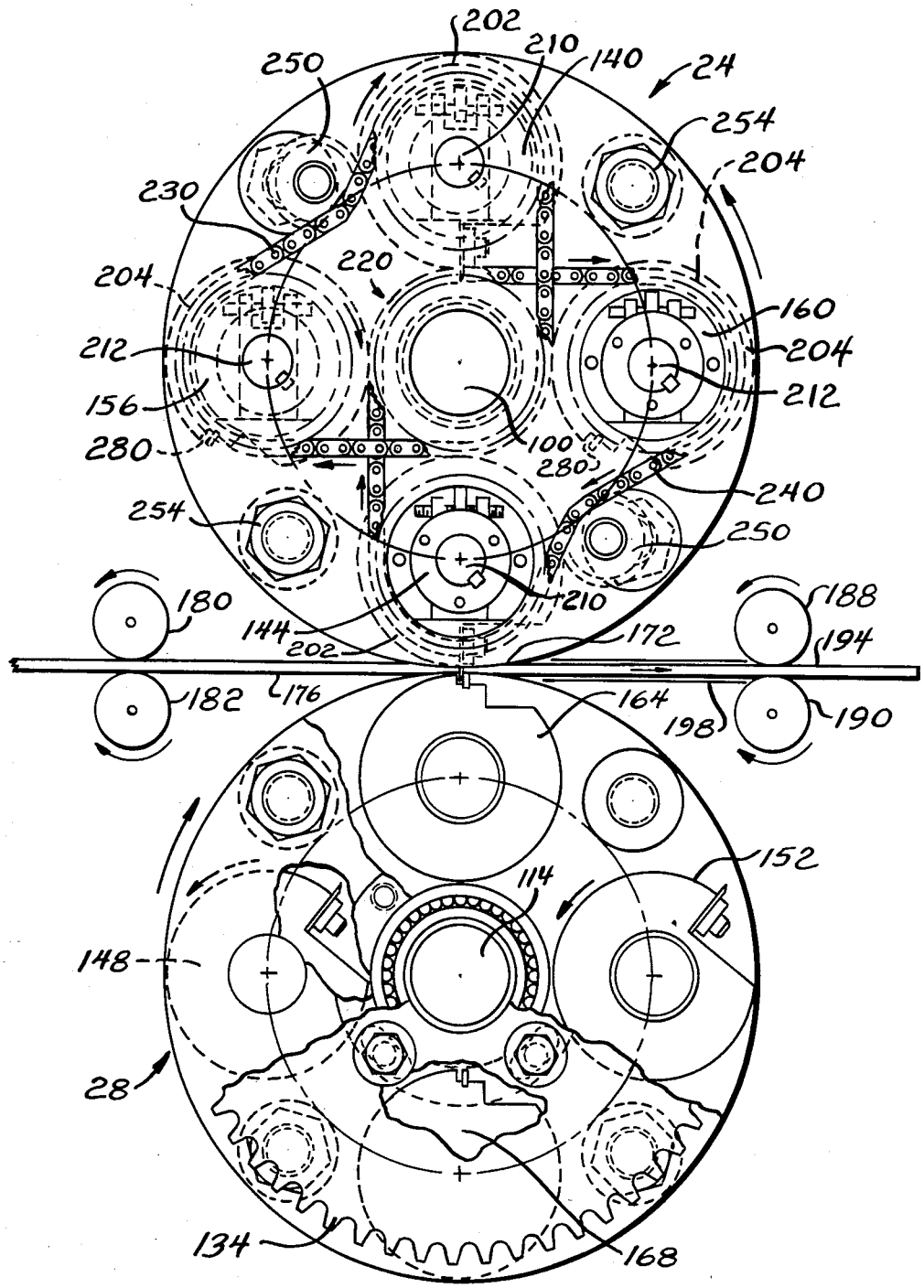
FIG. 4 is an elevation, in the axial direction, of the roll assemblies of the invention indicating schematically the web driving rollers for feeding the web into and for withdrawing the cut sheet from the cutting mechanism of the sheeter and with portions of the roll assemblies cut away to show the drive sprockets of the roll assemblies and the cutter axle coupled to the cutter rolls and ro the slot rolls by means of drive chains trained over a center axle sprocket and over roll-carried sprockets.
Figure 5:
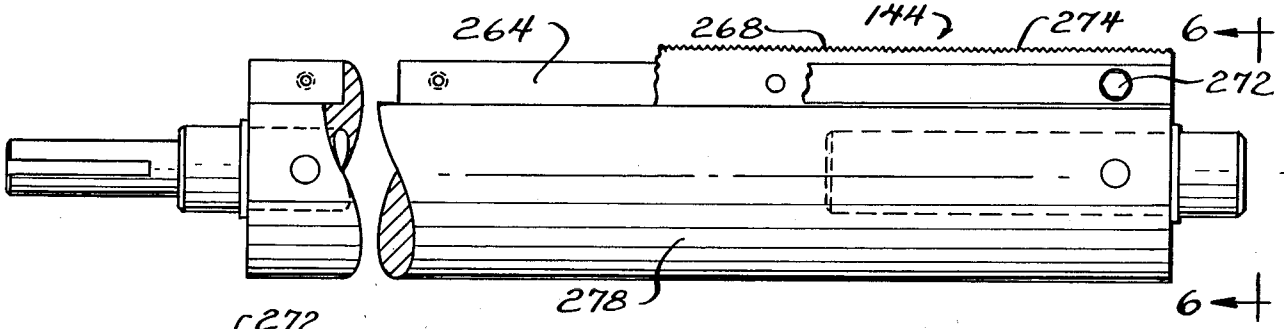
FIG. 5 is a side elevational view of a knife-blade-carrying cutter roll of the sheeter of the invention.
Figure 8:
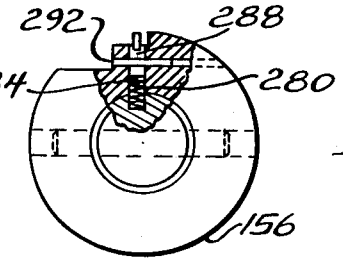
FIG. 8 is an end view of the slot roll, partly in section, taken along the lines 8—8 of FIG. 7 and showing structural details of the slot-defining mechanism of the roll.

Referring now to the drawings, and particularly to FIGS. 1, 3 and 4, there is shown, for illustrative purposes and not in any limiting sense, one preferred embodiment of the rotary sheeter of the invention incorporating the features thereof. As shown, the rotary sheeter 20 includes an upper elongated, generally cylindrical rotatable roll assembly 24 coextensive with and paralleling a lower roll assembly 28 supported on upper and lower pairs of bearings 30 and 32 on a frame 40 including forward and rearward vertically extending channel members 44 and 46 and 48 and 50 projecting upwardly of a transversely disposed base 54 including a pair of laterally spaced channel irons 60 and 62. In the particular embodiment of the invention illustrated in FIGS. 1 and 2, the base 54 supports a transversely extending horizontal plate 70 on which there is mounted a motor drive assembly 74 including an electrical motor 76 and a speed reducer 80 connected thereto. A pair of axles 84 and 86 journalled 88 in the channels 60 and 62 support rollers or wheels 92 which ride on rails 100.

Each roller assembly 24 and 28 includes a center shaft or axle 110 and 114 carried by the pair of opposed bearings 30 and 32 as indicated schematically in FIG. 3. Throughout the following description references will be primarily to a given roll assembly. Since the two roll assemblies are of essentially the same construction except that they are rotated in opposite directions, description of one will apply as well to the other.

Axially inwardly of their ends, the center axles 110 and 114 of the roll assemblies 24 and 28 carry sprocket drive gears 130 and 134, and a sprocket chain 140 coupled on a drive sprocket 144 of the speed reducer 80 is trained over an idler sprocket 146 and the sprockets 130 and 134 so as to effect rotation of the roll assemblies 24 and 28 in opposite annular directions, but synchronized at the same rotational speed. As indicated schematically in FIGS. 3 and 4, and as described herebelow with reference to one of the roller assemblies 24 and 28, each roller assembly includes an array of alternating cutter rollers 140 and 144 (on roll assembly 24) and 148 and 152 (on roll assembly 28) and slot rolls 156 and 160 (on roll assembly 24) and 164 and 168 (on roll assembly 28), the cutter and the slot rolls constituting in each roll assembly an array of equally spaced rolls disposed in an alternating cutter roll and slot roll sequence around each respective roll assembly within an encircling bounding marginal zone of each of the roll assemblies and at an equal radial distance from respective center axles 110 and 114 of the roll assemblies.

The cutter rolls and the slot rolls carried by the respective roll assemblies are disposed in an out-of-phase sequence with respect to cooperating cutter rolls and slot rolls carried by the opposed roll assembly to establish a registering relationship in which a given cutter roll, for example, 144 or 140 of one roll assembly 24 approaches proximate to and directly opposite to oppose a cooperating slot roll 164 or 168 of the other roll assembly 28 as the roll assemblies revolve in opposite directions about their respective axes 110 and 114.

As indicated schematically in FIG. 4, the roll assemblies 24 and 28 are spaced from each other to define a limited passageway 172 for accommodating a web 176 of sheet material moving freely therethrough.

As further indicated schematically in FIG. 4, a pair of motor driven feed rolls 180 and 182 move the web 176 into the passage 172 at a lineal speed which corresponds to the circumferential lineal speed of the roll assemblies 24 and 28, and a second pair of driven rollers 188 and 190 in the output zone of the passageway 172 serve as pick-up rolls to remove the severed web segments 194 after the web has been cut by the cooperating cutter roll 144 and slot roll 164 and passes through a web guide 198.

As indicated schematically in FIG. 4, and as also seen in FIG. 3, each of the cutter rolls and each of the slot rolls of roll assembly 24 carries a sprocket wheel 202 and 204 affixed to the cutter roll axles 210 and to the slot roll axles 212.

Also as shown in FIG. 3 and as indicated schematically in FIG. 4, the center axle 110 of the roll assembly 24 carries a hub assembly 220 having two axially spaced sprocket wheels 224 and 226. A roller chain 230 is trained over one of the sprocket wheels 226 of the hub 220 and over the sprocket wheels 202 and 204 of one pair 140 and 156 of the cutter rolls and slot rolls while a second roller chain 240 is trained over the sprocket wheel 224 of the center axle 110 and over the sprocket wheels 202 and 204 of the other pair of cutter rolls and slot rolls 144 and 160. The assemblies described include suitable spacer or take-up rollers 250 for maintaining the drive chains 230 and 240 in proper tension. Tie rods 254 extending longitudinally through the roll assembly 24 stabilize the structure.

Figure 6:
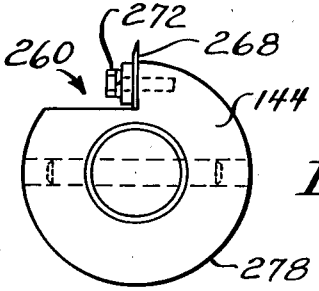
FIG. 6 is an end view of the cutter roll taken along the lines 6—6 of FIG. 5, and showing the manner of securement of the knife-blade in the cutter roll.
Figure 7:
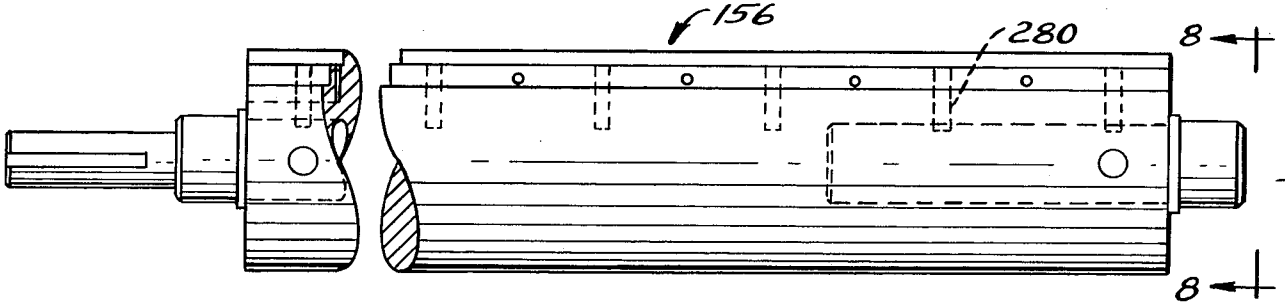
FIG. 7 is a side elevational view of a slot roll of the sheeter of the invention.

The enlarged elevational views of FIGS. 5 through 8 show the general construction of the cutter rolls 144 and the slot rolls 156. As shown in FIG. 6, the slot roll 144 is generally cylindrical in form and is cut away at its periphery to define a sector 260 bounded by a radially extending wall 264 to which a knife-blade 268 is bolted 272 so that a serrated edge 274 of the knife-blade 268 projects radially beyond the outer surface 278 of the cylindrical roll 144.

The slot roll 156 is of the same overall general construction as is the cutter roll 144, but is formed with a plurality of radially inwardly directed cavities 280, each housing a spring 284 which resiliently urges a cutter bar 288 radially outwardly of the slot roll 156. The cutter bar 288 is retained in position by means of a dowel pin 292 which limits the extent to which the cutter bar 288 may be urged radially outwardly of the assembly.

In a preferred embodiment of the invention, and as indicated schematically in FIG. 2, the center axles 110 and 114 of the roll assemblies 24 and 28 are fixed against rotation as the roll assemblies revolve, and the double sprocket wheel assembly 220 carrying the sprockets 224 and 226 is fixed on the center axle 110. In the specific embodiment of the invention deoicted the center axle 110 is coupled through a cam or lever 300 to an air piston-and-cylinder assembly 304 by means of which the cam 300 and the center axle 110 attached thereto may be selectively shifted through an annular arc of about 45°. Suitable adjustable stops 308 and 310 are provided to define the precise limits of the movement of the cam 300. The piston-and-cylinder assembly 304 is connected to a valve 320 which is in turn connected to a pump or pressurized air supply 324 and to a timer 328. A similar mechanical arrangement is shown for controlling the movement and positioning of the center axle 114 of the second roll assembly 28. As shown, the mechanism includes a cam 330, a piston-and-cylinder 334, adjustable stops 338 and 340 and a control valve 350, the latter being connected to the pump 324 and the timer 328 so that the two piston-and-cylinder assemblies 304 and 334 which control the movement of the center axles 220 and 114 act in unison.

Referring now to FIG. 4, it will be appreciated that with the double sprocket wheel 220 affixed to the immobilized center axle 110, as the roll assembly 24 revolves, counterclockwise as shown in FIG. 4, the roll chains 230 and 240 which are trained on the sprocket wheel 226 and 224 of the assembly 220 and on the sprockets of the cutter rolls 144 and 140 and the slotted rolls 156 and 160 will cause the rolls to revolve with the roll assembly 24 as the latter is rotatably driven by the driven chain 140 coupled to the drive assembly 74 (FIG. 1). However, the cutter rolls 144 and 140 and the slot rolls 156 and 160 will undergo planetary revolution in a ferris-wheel fashion about the fixed axis 110 of the roll assembly 24 to maintain a fixed annular orientation of the cutter rolls 144 and 140 and the slot rolls 156 and 160 with respect to their own axes 210 and 212.

Referring further to FIG. 4, the cutter rolls and slot rolls there depicted are shown in an arrangement in which each roll is shifted essentially 45° annularly with respect to the roll there adjacent. As further shown with respect to the roll assembly 24 in FIG. 4, the cutter roll 144 is oriented so that the knife blade 268 comes into direct operational contact with the moving web 176 at the same time that the cutter roll 144 is in tangential abutment with the moving web 176. Then, as the roll assembly 24 rotates counterclockwise, to bring the next roll 156 (a slot roll) to the slot 172 through which the web 176 travels, the slot roll 156 maintains its annular orientation fixed with respect to its own axis 212. The slot 280 is 45 from the tangential point with respect to the moving web 176 when the roll 156 is essentially tangential to the moving web. Thus, in the orientation relationship depicted in FIG. 4 for roll assembly 24, the slot roll 156 is in an inoperative mode when the roll 156 is tangential to the moving web 176.

During functional operation of the sheeter of the invention, and as the roll assemblies 24 and 28 rotate, the cutter rolls and the slot rolls will be maintained in planetary motion about the center axles 110 and 114 and, concurrently, the cutter rolls and slot rolls will rotate ferris-wheel like to maintain a constant angular relation or annular orientation with respect to their own axes. This fixed orientation is disturbed only upon actuation of mechanisms for effecting annular shifting of the cutter and the slot rolls, as described below.

The present invention includes cam assemblies 300 and 330 by means of which the center axles 110 and 114 of the roll assemblies 24 and 28 may be shifted annularly or arcuately through an angle of about 45°. It will be appreciated that such a transformation will effect a change in the orientation of each cutter roll and each slot roll to modify the cutting pattern. For example, the annular shifting of the cutter rolls and slot rolls through the shifting of the shaft-carried double sprocket wheels 220 may be such as to orient the rolls so that more cutting or no cutting occurs. Thus, through appropriate programming of the camming mechanisms, the cutting cycle may be modified to permit a greater or lesser length of web to pass through the space 172 between the roll assemblies between successive severing operations. With appropriate timing selection and adjustment, web segments of any desired length may be readily produced.

The timing mechanisms and the types of valves to be used in regulating and controlling the operation of the roll shifting cam or lever assemblies 300 and 330 are not critical and do not constitute, per se, an element of the present invention. Rather, any preferred electrical and/or mechanical controls may be used, as are well known in the relevant art.

While this invention has been described with reference to preferred embodiments and procedures, it is evident that the invention is not limited thereto. Further modifications of the method and the apparatus disclosed herein which fall within the scope of the following claims will be immediately evident to those skilled in the art. To the extent that these changes and modifications are within the scope of the appended claims, they are to be considered a part of this invention.

What is claimed is:

1. In a method of cutting a continuously moving web of sheet material to provide severed sheet increments of selectable lengths, the steps of providing frame means for supporting a pair of elongate, generally cylindrical, rotatable roll assemblies lineally coextensively with one another and with fixed axes thereof parallel to each other, adjusting spatial separation of said roll assemblies with respect to each other to define limited passageway means therebetween for accommodating a web of sheet material moving freely therethrough, rotatably driving said roll assemblies in unison and at the same rotational velocity and each about a respective one of said fixed axes, but in opposite annular rotational modes as the web moves through the passageway means, mounting cutter rolls and slot rolls on said roll assemblies as an annular array thereon and within an encircling, bounding marginal zone of each of said roll assemblies, spacing said cutter rolls and said slot rolls equally and in an alternating sequence, and at equal radial distances from said axes of said assemblies, pivotally supporting said cutter rolls and said slot rolls for planetary revolution in a ferris-wheel fashion about the fixed axes of the roll assemblies as said roll assemblies rotate, and establishing and maintaining fixed annular orientation of said cutter rolls and said slot rolls with respect to their own axes as the roll assemblies rotate, providing actuator means for pivotally arcuately displacing said cutter rolls and said slot rolls, periodically selectively energizing said actuator means for pivtally shifting said cutter rolls and said slot rolls simultaneously through equal circumferential arcs to eatablish a functional mode of said cutter rolls and cooperating said slot rolls, controlling sequential presentation of a knife blade of a cutter roll into an opposedly presented slot of a cooperating slot roll at opposed sides of the passageway as the web passes therethrough, severing the moving web into incremental lineal segments of selectable lengths during travel of said web through the passageway, and driving said roll assemblies at circumferential lineal speeds corresponding to a lineal speed of the web of sheet material moving through the passageway therebetween, thereby obviating any need for maintaining an accumulation loop in the moving web.

2. Apparatus for cutting a continuously moving web of sheet material to provide severed sheet increments of selectable lengths, said apparatus comprising:

a pair of elongated, generally cylindrical rotatable roll assemblies having fixed axes, frame means for supporting said roll assemblies lineally coextensively with said fixed axes thereof parallel to each other, said roll assemblies being spaced from each other to define limited passageway means therebetween for accommodating a web of sheet material moving freely therethrough, each of said roll assemblies including a center axle, and a sprocket wheel carried by each said axle, drive means for rotatably driving said roll assemblies in unison and at the same rotational velocity and each about a respective one of said fixed axes, but in opposite angular rotational modes, said drive means including motor means and drive chain means coupling said motor means to said sprocket wheel for rotation thereof and of said roll assemblies in opposite annular modes, cutter rolls and slot rolls, and means mounting said cutter rolls and said slot rolls on said roll assemblies for orbital rotation about respective axes of said roll assemblies as said roll assemblies rotate, means coupling each said center axle of each of said roll assemblies to respective said cutter rolls and slot rolls mounted thereon for effecting simultaneous and synchronous rotation of said rolls and orbital revolution of said rolls about said center axle upon application of rotational torque to said sprocket wheel of each said roll assemblies, said cutter rolls and said slot rolls comprising an array of equally spaced rolls disposed in an alternating cutter roll and slot roll sequence around each respective said roll assemblies within an encircling bounding marginal zone of each of said roll assemblies and at equal radial distances from respective said axes thereof, each of said rolls including an axis spaced from and paralleling said axes of said roll assemblies, for pivotally supporting respective said cutter rolls and said slot rolls, and means coupled to said cutter rolls and to said slot rolls for maintaining said cutter rolls and said slot rolls in planetary, ferris-wheel-like revolution about said fixed axes of said roll assemblies while maintaining fixed orientation of said cutter rolls and said slot rolls with respect to each respective axis thereof, said cutter rolls and said slot rolls carried by a first of said pair of roll assemblies being disposed in an out-of-phase sequence with respect to cooperating cutter rolls and slot rolls carried by an opposed second of said pair of said roll assemblies with a given cutter roll of one of said roll assemblies located so as to approach proximate to and directly to oppose a cooperating slot roll of the other of said roll assemblies during ganged synchronous rotation of said roll assemblies in opposite directions about respective axes thereof, knife blade means carried by each of said cutter rolls to extend longitudinally therealong, and means supporting said knife blade means to project in a plane paralleling said axis of respective each of said cutter rolls and radially beyond a periphery of said cutter rolls during presentation of an outwardly extending cutting edge of said knife blade means to engage a web traveling through said passageway means to convert said web into cut sheets of selectable lengths, each of said slot rolls being formed with a slot extending longitudinally therealong and radially inwardly from a peripheral bounding circumference of said slot rolls for receiving a projecting free cutting edge of said knife blade means upon cutting engagement of said knife blade means with the web being severed.

3. The structure as set forth in claim 2 and further comprising cam means and connector means coupling said cam means to each of said cutter rolls and to each of said slot rolls carried by each of said roll assemblies for controlling annular orientation of said rolls within said roll assemblies as said roll assemblies rotate, cam actuator means for energizing said cam means to shift said cutter rolls and said slot rolls simultaneously through equal circumferential arcs for regulating sequential presentation of said knife blade means carried by a given cutter roll of one of said roll assemblies into an opposedly presented slot of a mating one of said slot rolls carried by the other of said pair of roll assemblies at opposite sides of said passageway means for severing of the web passing therethrough.

4. The structure as set forth in claim 3 wherein said cam means and said cam actuator means include means for imparting an annular shift to said cutter rolls and to said slot rolls simultaneously and in equal degrees for establishing, selectively, an inoperative, non-coupling relationship of said rolls in which no shearing of said web occurs and an operative functional orientation of said rolls in which said web is transformed to sheets of incremental lengths which are integral multiples of 1/n of the circumference of said roll assemblies, where n is the total of the number of cutter rolls and slot rolls carried by a given one of said roll assemblies.

5. The structure as set forth in claim 4 and further comprising timing means for adjustably controlling cyclical energization of said cam actuator means and concurrent annular shifting of said cutter rolls and said slot rolls between an operative and an inoperative mode to regulate and to define lineal dimensions of incremental lengths of cut sheet severed from the web.

6. The structure as set forth in claim 4 wherein said means for imparting annular shift to said cutter rolls and to said slot rolls includes means for shifting said rolls annularly through an arc of about 45 degrees.

7. The structure as set forth in claim 3 wherein said cam means comprises means for controlling said knife blade means of said cutter rolls and said slot of said slot rolls for establishing selectable spaced incremental time intervals between functional transitory entry of said knife blade means into said slot to present said knife blade means to project in a plane extending transversely of and normal to a plane of web passing through said passageway means between said roll assemblies to sever the web into lineal segments of selectable lengths.

8. The structure as set forth in claim 3 and further comprising axle means carried by said frame means for supporting each of said roll assemblies thereon, sprocket means carried on said axle means and fixed thereto for rotation therewith, drive means trained on said sprocket means and drivingly connected to said cutter rolls and to said slot rolls, and wherein said connector means coupling said cam means to each of said cutter rolls and said slot rolls comprise keyway means fastening said cam means to said axle means for effecting annular displacement of said axle means upon annular shifting of said cam means.

9. The structure as set forth in claim 3 wherein said cam actuator means comprises a piston-and-cylinder assembly including a cylinder body and piston rod means extending axially therefrom, bolt means for anchoring one end of said body to a frame fixed with respect to said roll assemblies, coupling pin means for securing an outwardly extending end of said piston rod means to said cam means, and said piston rod means constituting means for effecting displacement of said cam means upon actuation of said piston rod means.

10. The structure as set forth in claim 2 and further comprising means for feeding the web through said passageway means at a lineal speed essentially equal to a circumferential lineal speed of said roll assemblies.

11. The structure as set forth in claim 2 wherein said means coupling each said center axle of each of said roll assemblies to respective said cutter rolls and said slot rolls mounted thereon comprises, in combination, sprockets carried on each of said rolls and cooperating said sprocket wheel carried on said center axle, and drive means coupling said sprockets of said rolls with said sprocket wheel of said axle, for application of rotational forces to said rolls through said sprocket wheel during rotation of said roll assemblies.

12. The structure as set forth in claim 11 wherein said drive means comprise a pair of chains engaging said sprockets of said rolls and said sprocket wheel of said center axle, said drive means being operative in each of said roll assemblies, each one of said pair of chains being operatively connected to a different one of said roll assemblies and each one of said pair of chains being coupled to cooperating said sprocket wheel on said center axle.

13. The structure as set forth in claim 12 wherein said sprocket wheel on said center axle includes a pair of coaxial drive-means-engaging wheels, and wherein said center axle comprises shaft means supporting said pair of wheels for rotative displacement therewith.

14. The structure as set forth in claim 13 and further comprising key means for locking said center axle against rotation as said roll assemblies revolve.

15. The structure as set forth in claim 2 and further comprising intercoupling means for establishing and maintaining said slot rolls and said cutter rolls in a predetermined orientational mode for planetary revolution in a ferris-wheel fashion about said fixed axes of said roll assemblies during rotation thereof.

16. The structure as set forth in claim 15 wherein said intercoupling means include first sprocket means carried by said roll assemblies at said fixed axes thereof and second sprocket means carried by said cutter rolls and said slot rolls at respective axes thereof, and chain means trained over said first and said second sprocket means and mechanically interconnecting said roll assemblies with said cutter rolls and with said slot rolls for synchronous ganged pivotal displacement.

17. The structure as set forth in claim 2 and further comprising lever means and connector means coupling said lever means to each of said cutter rolls and to each of said slot rolls carried by each of said roll assemblies for controlling annular orientation of said rolls within said roll assemblies as said roll assemblies rotate.

18. The structure as set forth in claim 17 and further comprising means for supporting said lever means for pivotal movement for effecting shifting of said cutter rolls and said slot rolls simultaneously through equal circumferential arcs for regulating sequential presentation of said knife blade means carried by a given cutter roll of one of said roll assemblies into an opposedly presented slot of a mating one of said slot rolls carried by the other of said pair of roll assemblies at opposite sides of said passageway means for severing of the web passing therethrough.

19. Apparatus for cutting a continuously moving web of sheet material to provide severed sheet increments of selectable lengths, said apparatus comprising:

a pair of elongated, generally cylindrical rotatable roll assemblies having fixed axes, frame means for supporting said roll assemblies linearly coextensively with said fixed axes thereof parallel to each other, said roll assemblies being spaced from each other to define limited passageway means therebetween for accommodating a web of sheet material moving freely therethrough, drive means for rotatably driving said roll assemblies in unison and at the same rotational velocity and each about a respective one of said fixed axes, but in opposite angular rotational modes, cutter rolls and slot rolls, and means mounting said cutter rolls and said slot rolls on said roll assemblies for orbital rotation about respective axes of said roll assemblies as said roll assemblies rotate, said cutter rolls and said slot rolls comprising an array of equally spaced rolls disposed in an alternating cutter roll and slot roll sequence around each respective said roll assemblies within an encircling bounding marginal zone of each of said roll assemblies and at equal radial distances from respective said axes thereof, each of said rolls including an axis spaced from and paralleling said axes of said roll assemblies, for pivotally supporting respective said cutter rolls and said slot rolls, and means coupled to said cutter rolls and to said slot rolls for maintaining said cutter rolls and said slot rolls in planetary, ferris-wheel-like revolution about said fixed axes of said roll assemblies while maintaining fixed orientation of said cutter rolls and said slot rolls with respect to each respective axis thereof, said cutter rolls and said slot rolls carried by a first of said pair of roll assemblies being disposed in an out-of-phase sequence with respect to cooperating cutter rolls and slot rolls carried by an opposed second of said pair of said roll assemblies with a given cutter roll of one of said roll assemblies located so as to approach proximate to and directly to oppose a cooperating slot roll of the other of said roll assemblies during ganged synchronous rotation of said roll assemblies in opposite directions about respective axes thereof, knife blade means carried by each of said cutter rolls to extend longitudinally therealong, and means supporting said knife blade means to project in a plane paralleling said axis of respective each of said cutter rolls and radially beyond a periphery of said cutter rolls during presentation of an outwardly extending cutting edge of said knife blade means to engage a web travelling through said passageway means to convert said web into cut sheets of selectable lengths, each of said slot rolls being formed with a slot extending longitudinally therealong and radially inwardly from a peripheral bounding circumference of said slot rolls for receiving a projecting free cutting edge of said knife blade means upon cutting engagement of said knife blade means with the web being severed.

20. The structure as set forth in claim 9 wherein each of said roll assemblies includes a center axle, and a sprocket wheel carried by each said axle, and wherein said drive means includes motor means and drive chain means coupling said motor means to said sprocket wheel for rotation thereof and of said roll assemblies in opposite annular modes.

21. The structure as set forth in claim 20 and further comprising means coupling each said center axle of each of said roll assemblies to respective said cutter rolls and slot rolls mounted thereof for effecting simultaneous and synchronous rotation of said rolls and orbital revolution of said rolls about said center axle upon application of rotational torque to said sprocket wheel of each said roll assemblies.

22. In apparatus for cutting a continuously moving web of sheet material to provide severed sheet increments of selectable lengths, said apparatus including a pair of elongate, generally cylindrical rotatable roll assemblies, each of said roll assemblies including a center axle, and a sprocket wheel carried by each said axle, frame means for supporting said roll assemblies linearly coexensively with said fixed axes thereof parallel to each other, said roll assemblies being spaced from each other to define a limited passagway therebetween for accommodating a web of sheet material moving freely therethrough, drive means, including motor means and drive chain means coupling said motor means to said sprocket wheel for rotatably driving said roll assemblies in unison and at the same rotational velocity and each about a respective one of said fixed axes, but in opposite annular rotational directions, cutter rolls and slot rolls, and means mounting said cutter rolls and said slot rolls on said roll assemblies, means coupling each said center axle of each of said roll assemblies to respective said cutter rolls and slot rolls mounted thereon for effecting simultaneous and synchronous rotation of said rolls and orbital revolution of said rolls about said center axle upon application of rotational torque to said sprocket wheel of each said roll assemblies, and means for supporting said cutter rolls and said slot rolls for planetary revolution in a ferris-wheel fashion about said center axle of respective each said roll assemblies, and including means for establishing and maintaining, during rotation of said roll assemblies, a fixed annular orientation of said cutter rolls and said slot rolls with respect to their own axes, displacement means for effecting incremental annular shifting of said cutter rolls and said slot rolls about respective axes thereof, said displacement means being operable to establish selectively a stand-by mode and an operative mode of said cutter rolls and said slot rolls during movement of a web of sheet material through said passageway.

23. The apparatus as set forth in claim 22 wherein said drive means for driving said roll assemblies includes means for driving said roll assemblies at a circumferential lineal speed corresponding to a lineal speed of a web of sheet material moving through said passageway between said roll assemblies, thereby obviating any need for maintaining an accumulation loop in the moving web.

* * * * *

UNITED STATES PATENT AND TRADEMARK OFFICE

CERTIFICATE OF CORRECTION

PATENT NO. : 4,742,741

DATED : May 10, 1988

INVENTOR(S) : Edwin A. Hallberg and Gary C. Welsh

It is certified that error appears in the above-identified patent and that said Letters Patent is hereby corrected as shown below:

Column 3, line 21, "o" should read --on--.
Column 3, line 52, "driven unison;" should read --driven in unison;--.
Column 4, line 4, "ro" should read --to--.
Column 4, line 23, "weo" should read --web--.
Column 4, line 45, "to" should read --so--.
Column 7, line 60, "deoicted" should read --depicted--.
Column 9, line 44, "roIls" should read --rolls--.
Column 9, line 57, "pivtally" should read --pivotally--.
Column 9, line 59 "eatablish" should read --establish--.
Column 12, line 17, following "assemblies," insert therefor --and--.
Column 14, line 30, "thereof" should read --thereon--.

Signed and Sealed this

Sixteenth Day of May, 1989

*Attest:*

*Attesting Officer*

DONALD J. QUIGG

*Commissioner of Patents and Trademarks*